United States Patent [19]

Waegaert

[11] 4,236,536

[45] Dec. 2, 1980

[54] METHOD FOR WRAPPING CIGARS OR LIKE ARTICLES IN AN OUTER ENVELOPE OF NATURAL TOBACCO

[75] Inventor: Pierre Waegaert, Bordeaux, France

[73] Assignee: Service d'Exploitation Industrielle des Tabacs et des Allumette, France

[21] Appl. No.: 889,204

[22] Filed: Mar. 23, 1978

[30] Foreign Application Priority Data

Mar. 31, 1977 [FR] France ..... 77 09684

[51] Int. Cl.[3] ..... A24C 1/04; A24C 1/28; A24C 1/30

[52] U.S. Cl. ..... 131/33; 131/36; 131/58; 131/60; 131/105

[58] Field of Search ..... 131/15, 58, 60, 20 R, 131/21 R, 23 R, 27 R, 26, 32, 36, 105

[56] References Cited

U.S. PATENT DOCUMENTS 3,358,707 12/1967 Pirat ..... 131/33

*Primary Examiner*—V. Millin

*Attorney, Agent, or Firm*—Jacobs & Jacobs

[57] ABSTRACT

A method for wrapping cigars or like articles in an outer envelope, or wrapper, made of natural tobacco, which comprises the steps of: at least partially spreading out a non-stripped tobacco leaf, cutting out a first batch of wrappers from one of the half-leaves on one side of the midrib, turning the leaf over onto its other face, spreading out the half-leaf which has not yet been cut out, cutting out a second batch of wrappers from this half-leaf, then rolling cigars or like articles in these two batches of wrappers, reversing the direction of rolling when passing from the wrappers of the first batch to those of the second batch.

2 Claims, 6 Drawing Figures

METHOD FOR WRAPPING CIGARS OR LIKE ARTICLES IN AN OUTER ENVELOPE OF NATURAL TOBACCO

The present invention relates to a method for wrapping cigars or like articles, i.e. a method for providing these articles with an outer envelope of natural tobacco, this envelope currently being called outer leaf or wrapper.

For reasons of good presentation, it is conventional to roll the cigars in wrappers in such a way that the secondary veins of the leaf project inwardly, these veins extending virtually parallel to the axis of the cigar when said cigar is terminated. To obtain this result, two symmetrical machines are used (by reason of the obliqueness of the secondary veins with respect to the main, so-called midrib) for wrapping the cigars, said machines called "right-hand" and "left-hand" depending on whether wrappers cut out from the so-called right-hand half-leaves of tobacco or so-called left-hand half-leaves of tobacco are used: the notion of right and left for the sense of the leaf or the wrapper being defined when the leaf is considered in its natural habit on the plant, i.e. tip upward and projection of the veins behind.

On each machine, which machines function identically, whether it is "right-hand" or "left-hand", the half-leaf is cut out on the cut-out template, the veins of this half-leaf facing said template. The cut-out wrapper is conveyed to the wrapping station, its veins being parallel to the axis thereof. The unwrapped cigar is then rolled in the wrapper by rotating between the rollers, of parallel axes, at said station which are all driven in the same direction, the direction of rotation of the rollers being different depending on whether the machine is right-hand or left-hand. The cigar thus enveloped comprises hardly visible veins which are parallel to its axis.

To distribute the right-hand half-leaves and the left-hand half-leaves respectively to the "right-hand" and "left-hand" machines which correspond thereto and which are symmetrical, the leaves are subjected to stripping, i.e., they are cut into two along the axis of the midrib and the right- and left-hand halves are piled separately and distributed respectively to the "right-hand" and "left-hand" machines.

It is an object of the present invention to simplify the conventional methods by using whole, non-stripped tobacco leaves for the wrapper, either right-hand or left-hand and without modifying their good presentation. In this way, the stripping operation is spared and the users of the machines receive leaves which are easier to handle, without expensive tobacco being wasted near the rib and without any incipient tear.

To this end, the invention provides, after a non-stripped tobacco leaf has been at least partially spread out, cutting out a first batch of wrappers from one of the two half-leaves, on one side of the midrib, turning the leaf over onto its other face and spreading out the half-leaf which has not yet been cut out, cutting out a second batch of wrappers from this half-leaf, then rolling cigars or like articles in these two batches of wrappers, reversing the direction of rolling when passing from the wrappers of the first batch to those of the second batch.

When rolling on machines with a wrapping station, the reversal of the direction of rolling is obtained by reversing the direction of rotation of the rollers which constitute this station. If the leaf is turned over so that the axis of the midrib remains parallel to itself after having been turned over, it is possible, by reversing the direction of rolling, to maintain the secondary veins projecting inwardly of the cigar and always parallel to the axis of cigar, as in the case of the cigar enveloped in a wrapper coming from the leaf before being turned over.

The invention will be more readily understood on reading the following description with reference to the following drawings, in which.

Figure 1:
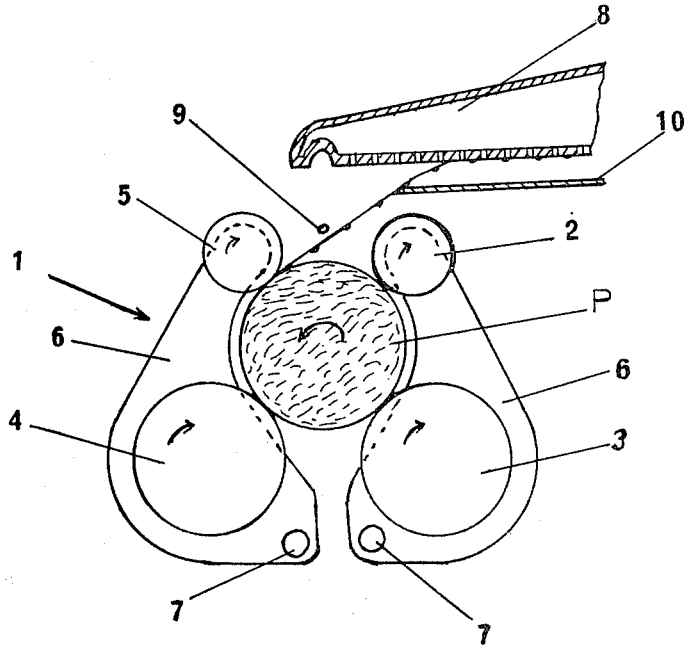
FIG. 1 is a view in section of the wrapping station when a cigar is being rolled in a wrapper coming from the first batch of wrappers.
Figure 2:
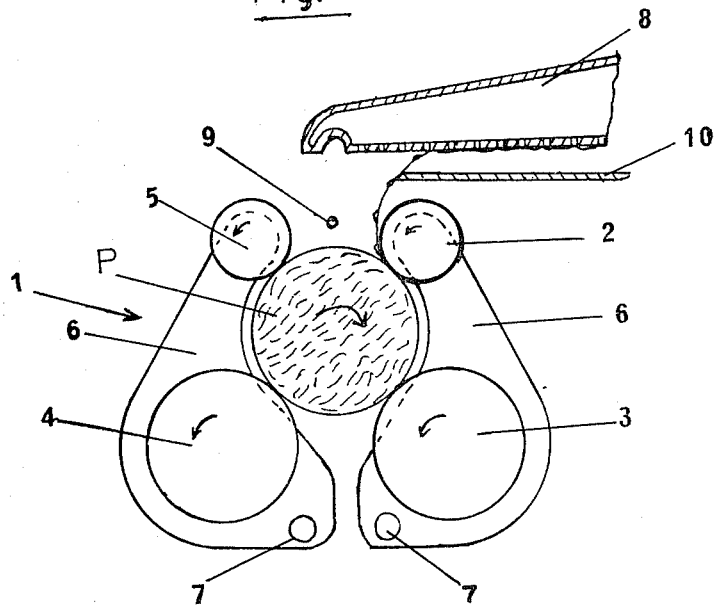
FIG. 2 is a view in section of the wrapping station when a cigar is being rolled in a wrapper coming from the second batch of wrappers.

Referring now to the drawings, FIGS. 1 and 2 show a wrapping station 1 which is conventionally constituted by four rotating rollers 2, 3, 4, 5 carried by two pairs of jaws 6 which may pivot about axes 7, to receive or release the unwrapped cigar P. For substantially cylindrical cigars, the axes of these rollers are parallel to one another and parallel to that of the unwrapped cigar P. For wrapping this cigar, the rollers are driven in rotation by a common drive member and via gears or intermediate rollers. They thus rotate on themselves, all in the same direction, driving the unwrapped cigar in the opposite direction.

Above the wrapping station, a suction head 8 moves between the cut-out template 11 where it takes up the wrapper and the position shown in FIGS. 1, 2, 4 and 6 where it stops an instant. A device of known type, such as a needle 9, then takes the front end of the wrapper and brings it into contact with the unwrapped cigar, driven in rotation on itself, and the suction head immediately passes above the wrapping station 1. A plate 10 located between the rollers and the suction head stretches the wrapper which is detached from the head 8 as it is rolled and ensures the smoothness of the envelope.

Figure 3:
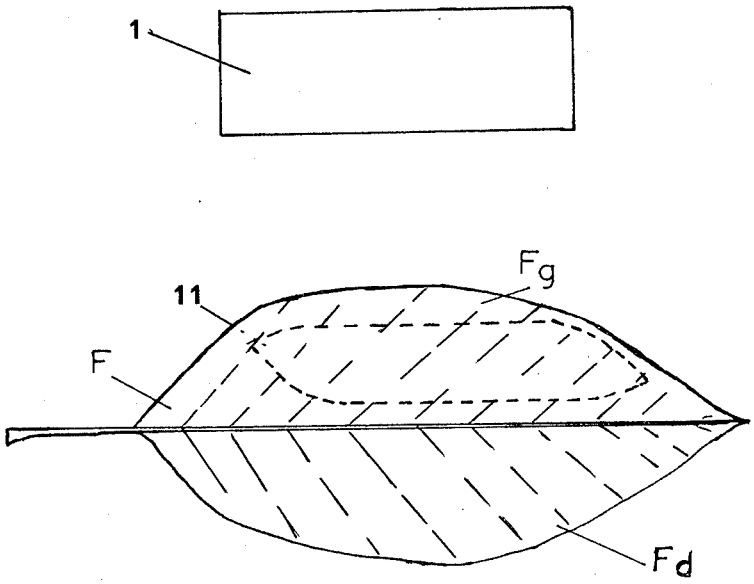
FIGS. 3, 4, 5, 6 are diagrams illustrating the sequence of the operations of the method.
Figure 4:
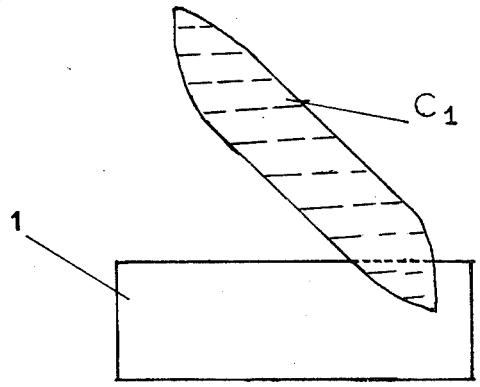
Figure 4:
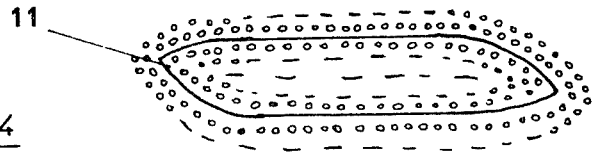

To explain the method, reference will be made in particular to FIGS. 3, 4, 5, 6, it being assumed, to simplify matters, that one wrapper only is cut out from each half-leaf. The generalization to any number of wrappers will be made without difficulty. FIG. 3 diagrammatically shows the wrapping station 1 and the cut-out template 11. The operator spreads a whole leaf F, previously softened by humidification, out on said template, so that the left-hand part Fg adheres to the template, the secondary veins of the leaf (indicated by light broken lines) being in contact with said template. A cutting device is then actuated cyclically and the cut-out wrapper $C_1$ is conveyed by the suction head 8 towards the wrapping station (while remaining parallel to the cut-out plane, the veins always being underneath) and presented as indicated in FIG. 3. The rollers then rotate in the direction as shown in FIG. 1 and the unwrapped cigar is rolled as is quite usual on this type of machine (apart from the fact that the operator has whole leaves to hand, everything occurs conventionally up to now).

Figure 5:
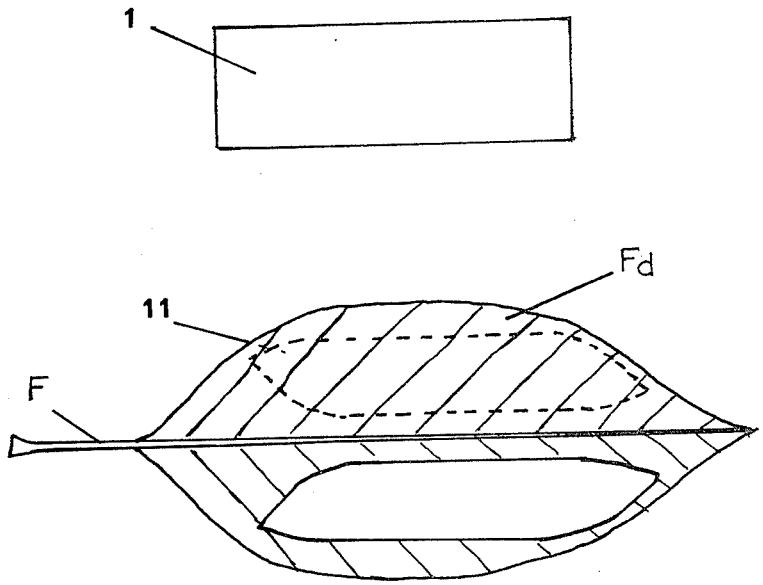
Figure 6:
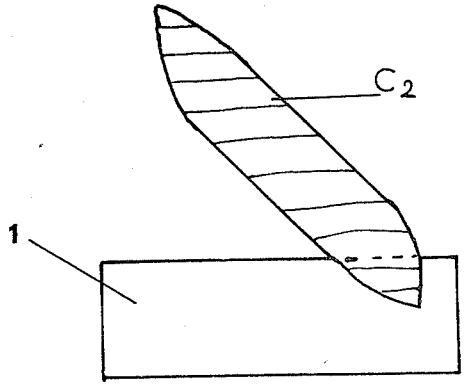
Figure 6:
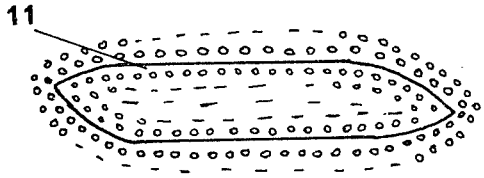

The remaining leaf Fd is then turned over and placed as indicated in FIG. 5 on the template 11, the secondary veins projecting upwardly (light solid lines). It is cut out and the corresponding wrapper $C_2$ is conveyed (FIG. 6) to the wrapping station, the veins still facing upwards. Before the needle 9 is actuated, the operator will have reversed the direction of rotation of the rollers (FIG. 2) by any suitable means. As the unwrapped cigar rotates in the direction opposite that of FIG. 1, the wrapper $C_2$ is helically wound in the direction opposite that of wrapper $C_1$, but the veins are again in contact with the unwrapped cigar.

The example shown is that of a leaf cut out on a machine for wrapping cigars conventionally, called "left-hand" machine. It will be readily appreciated that the same process may be executed on a so-called "right-hand" machine, the operations being symmetrical. For example, one starts by cutting out the half-leaf Fd, veins projecting downwardly, the direction of rotation of the rollers then being the normal direction for this machine, then the remaining half-leaf Fg is turned over and the direction of rotation of these rollers is reversed before wrapping.

This reversal may, for example, be coupled with another control action usually entrusted to the operator. Thus, it may be associated with a device which sweeps the scraps of leaves after all the available wrappers in a half-leaf have been cut out. In this case, the reversing device will be regulated so that it acts only at the beginning of the following cycle, i.e. only after the rolling of a cigar in the wrapper which has just been cut out.

It will be emphasized that the essential and absolutely novel phase of the method is the turning upside down of the leaf after the suitable number of wrappers has been cut out from the first half-leaf. It is this operation which makes it possible to cut out wrappers from the two halves of the leaf, on the same template, which wrappers, although they are always taken, in first approximation, longitudinally in the leaf (i.e. their large dimension makes with the midrib an angle much smaller than 45°), have, in both cases, correctly oriented secondary veins, so as to be substantially parallel to the axis of the finished cigar. The reversal of the direction of rotation is then effected so that, despite this turning upside down, the projecting veins are always facing the cigar.

It might appear that the time necessary for turning the leaf over causes a drop in production. This would be to neglect the time saved by handling a whole leaf instead of two successive half-leaves, and the continuous saving ensured by handling less fragiles leaves offering more grip. However, it goes without saying that, from the point of view of manpower, the essential saving is made by the elimination of stripping, which is a long, non integrated and tedious operation, carried out leaf by leaf.

What I claim is:

1. In the method of wrapping cigars or like articles in an outer envelope of natural tobacco leaf, the improvement which comprises cutting out at least one first wrapper from a half of a non-stripped, at least partially spread out tobacco leaf lying on one side of the midrib of said leaf; turning the leaf over onto its other face; spreading out the uncut half-leaf; cutting out at least one second wrapper from said uncut half-leaf, said first and second wrappers being aligned with their raised portions facing in opposite directions; feeding said aligned wrappers into a cigar rolling machine operable to wrap cigar wrappers about an unwrapped cigar core, so that the raised portions of said first wrapper face the outer surface of the core when being wrapped around said core; and prior to feeding said second wrapper into said machine, reversing the direction of rolling so that the raised portions of said second wrapper also face the outer surface of the core being wrapped.

2. The method according to claim 1 wherein the leaf is turned over so that the axis of the midrib when said second wrapper is cut is parallel to the axis of the midrib when said first wrapper is cut.

* * * * *